United States Patent [19]

Vanderlyn

[11] 4,180,952

[45] * Jan. 1, 1980

[54] ANCHORING SYSTEM

[76] Inventor: Donald Vanderlyn, Burger Rd., West Shokan, N.Y. 12494

[ * ] Notice: The portion of the term of this patent subsequent to Sep. 5, 1995, has been disclaimed.

[21] Appl. No.: 882,579

[22] Filed: Mar. 2, 1978

[51] Int. Cl.[2] ..... E04H 12/20

[52] U.S. Cl. ..... 52/148; 52/DIG. 11; 248/508; 52/166

[58] Field of Search ..... 24/68 E, 68 T, 68 R, 24/163, 197; 52/23, 148, 155, 157, DIG. 11, 166; 248/508, 509

[56] References Cited

U.S. PATENT DOCUMENTS

| | | | |
|---|---|---|---|
| 609,872 | 8/1898 | Campbell | 24/269 |
| 3,131,450 | 5/1964 | Zinkel | 24/197 |
| 3,747,288 | 7/1973 | Grimelii | 52/DIG. 11 |
| 3,754,733 | 8/1973 | Foster | 52/DIG. 11 |
| 3,774,364 | 11/1973 | Johnson | 52/23 |
| 3,830,457 | 8/1974 | Stewart | 248/508 |
| 3,845,597 | 11/1974 | Foster | 52/157 |
| 3,848,367 | 11/1974 | Barnes | 52/157 |
| 3,894,365 | 7/1975 | Abbott | 52/DIG. 11 |

*Primary Examiner*—James L. Ridgill, Jr.
*Attorney, Agent, or Firm*—John Maier, III

[57] ABSTRACT

An anchoring system for use in anchoring structures such as mobile homes to the ground by use of elongated flexible belts. The belt is wound so as to be firmly clamped by its own tension.

10 Claims, 6 Drawing Figures

ANCHORING SYSTEM

BACKGROUND OF THE INVENTION

1. Field of the Invention.

The present inventions relates to improvements in a system used to anchor structures and more particularly, to a new and improved anchoring system where the strap is held firmly in place by the anchor housing under its own tension.

2. Description of the Prior Art.

In the installation of structures, as for example mobile homes, it has been well-known that such structures, particularly where there is substantial wind, will blow over unless firmly held in place. Flexible belts, usually made from metal, are wrapped about the structure and anchored to the ground. Also, tie rods extend at an acute angle to the ground from the ground to the lower portion of the structure. The anchor housing is secured to the ground by a turn buckle at the same point that the tie rod is secured to the ground. The flexible belt is wrapped around the structure. The tie rod also includes a turn buckle for tensioning purposes.

Numerous anchoring devices have been known as, for example, those shown in the following patents:

| Inventor | U.S. Pat. No. |
|---|---|
| Barnes | 3,848,367 |
| Stewart | 3,830,457 |
| Foster | 3,754,733 |
| Grimelii | 3,747,288 |

Other patents show devices for various purposes but where an object is held down or together, as for example, the following:

| Inventor | U.S. Pat. No. |
|---|---|
| Johnson | 3,774,364 |
| Campbell | 609,872 |

One problem with existing anchoring apparatus is that it must be specially manufactured and cannot be put together in an inexpensive manner from available materials. Either special, perforated strap or slotted bolts are usually required. Frequently the housing of the anchoring apparatus is specially made to prevent rotation of the pin to which the strap is connected and tightened. As a result, the unit cost of each anchoring device is unduly high. In order to reduce the cost of securing a structure, frequently only an inadequate number of anchoring devices are used. The anchoring devices of the prior art are frequently not readily removable if firmly secured in the ground by concrete.

SUMMARY OF THE INVENTION

It is, therefore, an object of the present invention to provide an economical system for securing a structure to the ground thereby preventing damage due to high winds and other serious weather conditions by means of a simple and efficient system.

Another object is to provide a anchoring system which may be positively connected to the ground and still be removed and reused in a new location.

Another object is to provide an anchoring system which is easily and inexpensively installed.

Briefly, the present invention accomplishes these and other objects by providing flexible belts secured to pairs of anchor housings firmly connected to the ground with a tie rod located at an acute angle to the ground, and also connected at one end to the ground, in the same manner as is the anchor housing, and at the other end to the underside of the structure.

The flexible belt or strap is held rigidly in place on two pins in the anchor housing by its own tension. Tensioning of the strap is obtained by means of a hold-down turn buckle securely fastened in a vertical position between the ground and the anchor housing. The hold-down turn buckle is secured into the ground by a anchor foundation imbedded in the ground. A tie rod turn buckle in the tie rod permits tensioning of the tie rod separately from the strap.

Two pins are located in the anchor housing. The first or outer pin is located at the upper end of the housing adjacent the outer side of the anchor housing and the second or inner pin in a spaced relationship with the first pin either horizontally or vertically or at an acute angle with it. The end of the flexible belt is bent under the first pin and the second pin, over the top of the second and first pin, under the first pin and diagonally over the second pin down under the second pin and the first pin and up between its own two layers resulting in three layers of the belt engaging against the outside of the first pin.

The invention will be described with reference to the accompanying drawings.

Before explaining the present invention in detail, it is to be understood that the invention is not limited in its application to the details of the construction and to the parts illustrated in the accompanying drawings since the invention is capable of other embodiments and of being practiced or carried out in various ways. Also it is to be understood that the phraseology or terminology employed herein is for the purpose of description and not of limitation.

DETAILED DESCRIPTION

Figure 1:
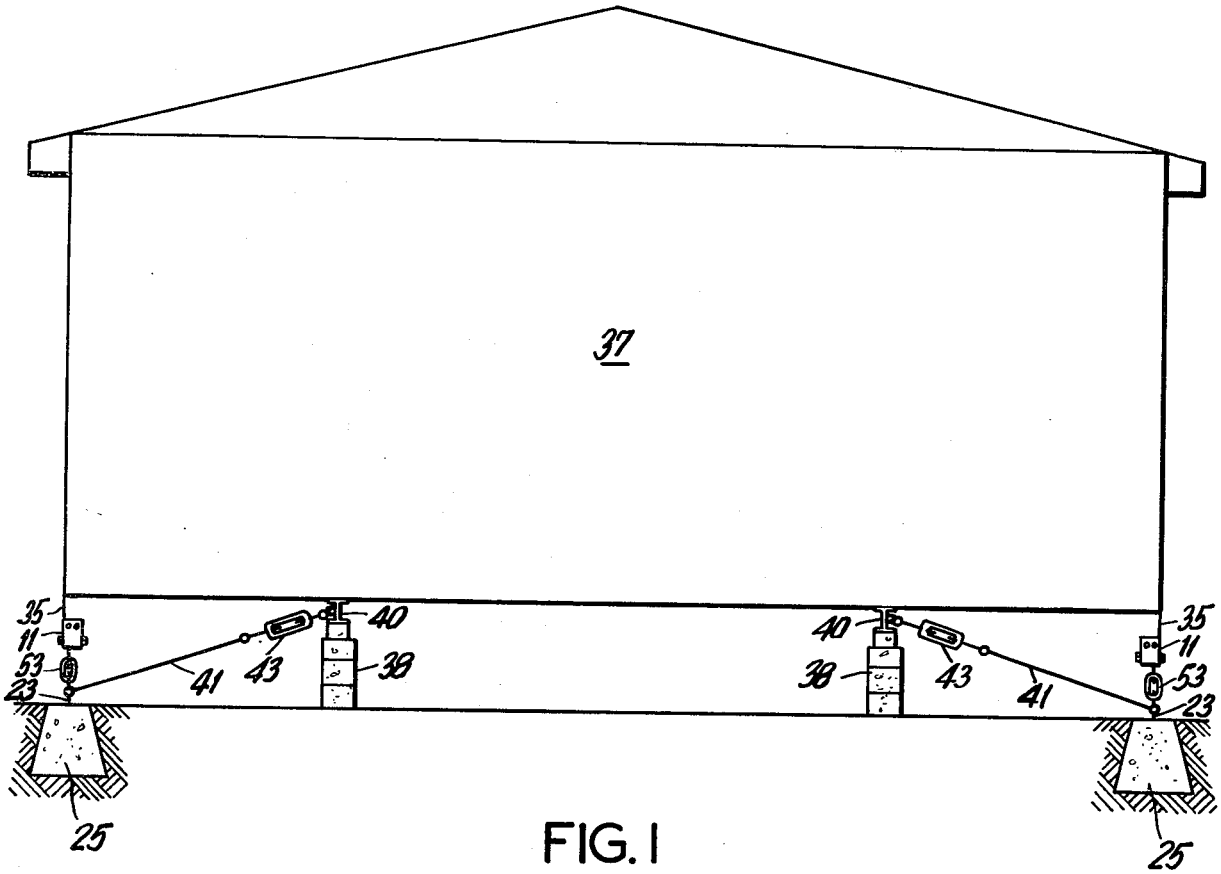
FIG. 1 is a side elevation showing the anchoring system connected to a structure with both the flexible band and the tie rod shown in place.
Figure 2:
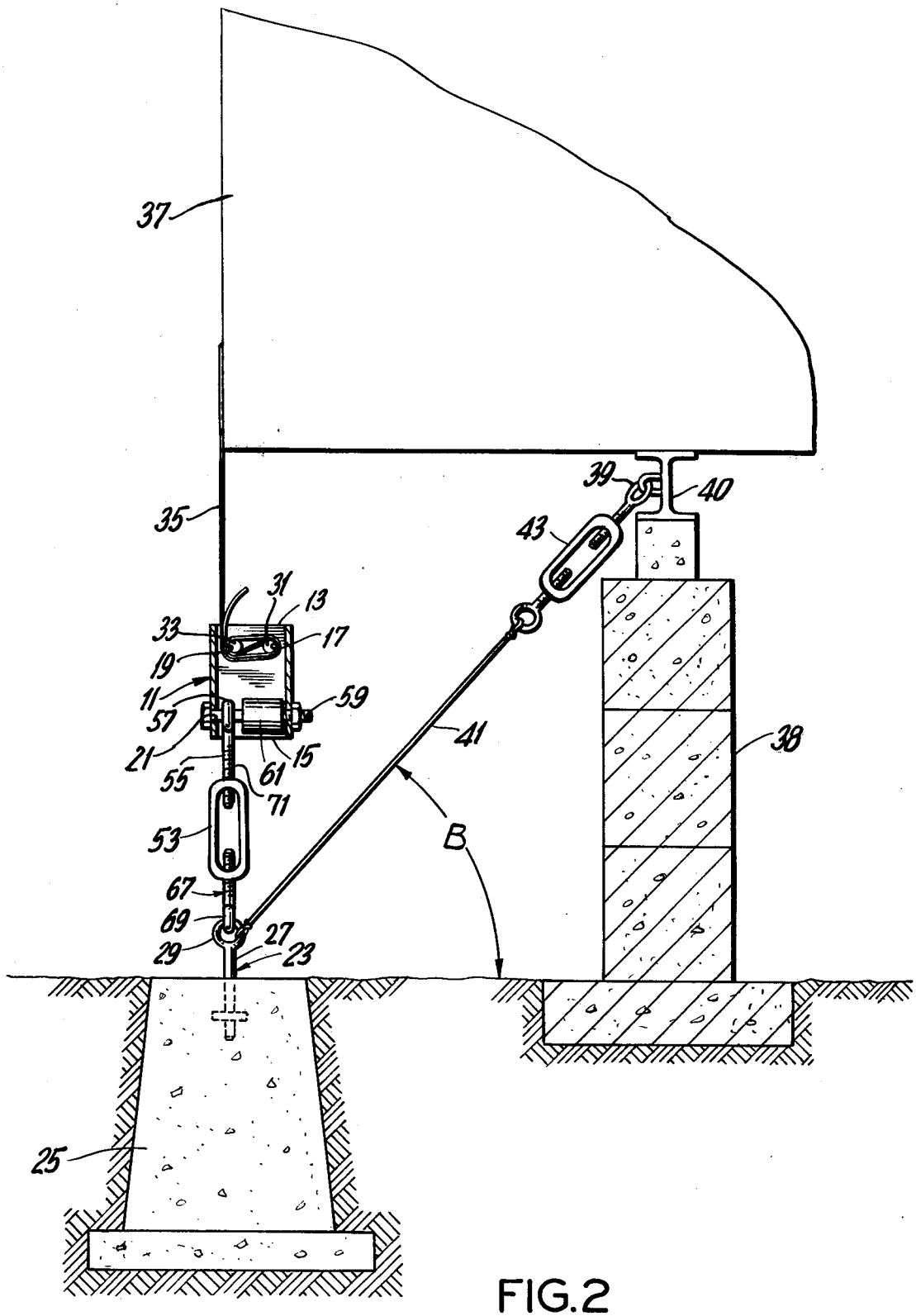
FIG. 2 is an enlargement of the left lower side of FIG. 1 showing the anchor housing and its connections including the tie rod in greater detail.

Referring now to the drawings, where like reference characters designate like or corresponding parts throughout the several views, there is shown in FIGS. 1 and 2 the anchor housing 11.

Figure 3:
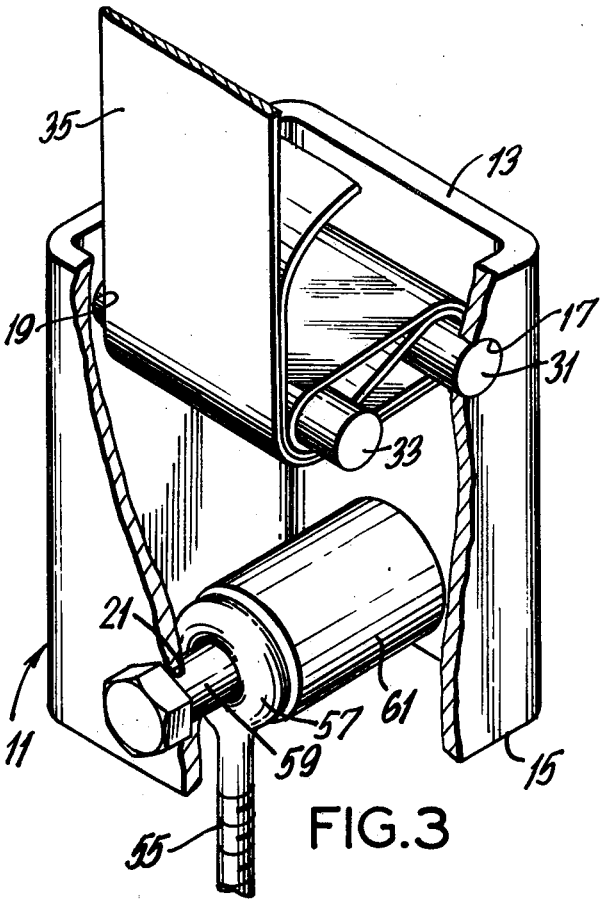
FIG. 3 is an perspective view of a first embodiment of the anchor housing.
Figure 4:
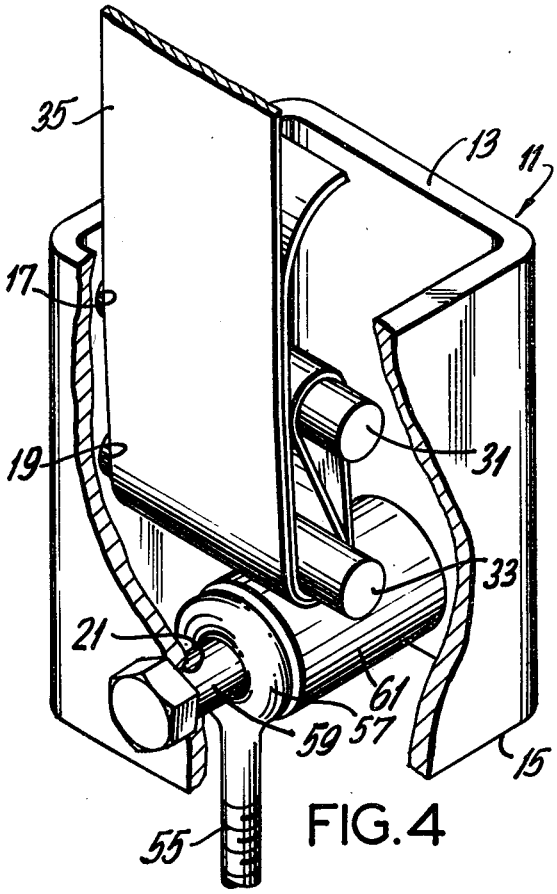
FIG. 4 is a perspective view of a second embodiment of the anchor housing.
Figure 5:
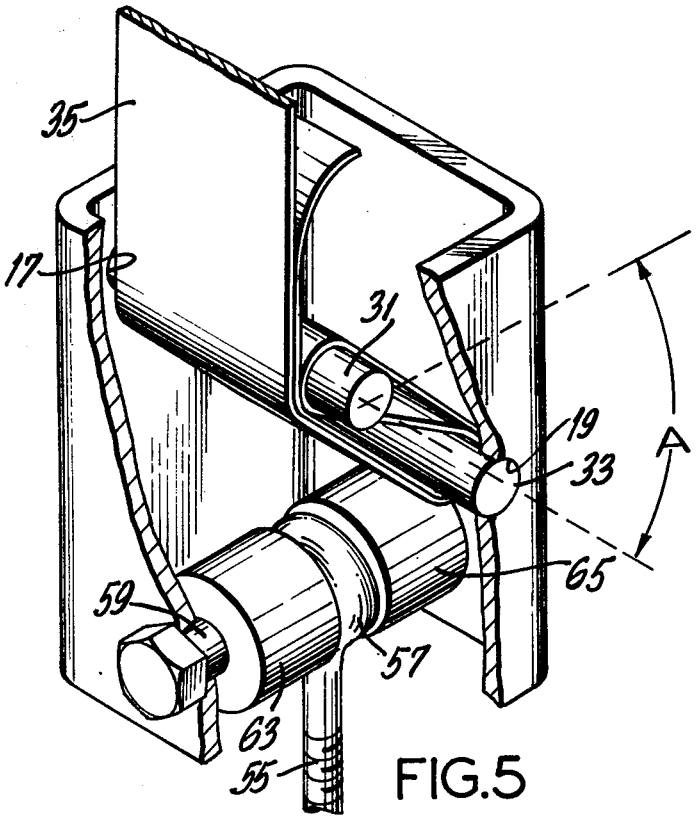
FIG. 5 is a perspective view of a third embodiment of the anchor housing.

The anchor housing 11 is formed preferable from square hollow structural tubing approximately two inches by two inches with a length of approximately three inches. The anchor housing 11 has an upper end 13 and a lower end 15. The first or outer opening 17 is aligned horizontally through the anchor housing 11 resulting in a pair of horizontal holes through two opposite sides of the hollow structural tubing being used. The first opening 17, as seen in FIG. 2 is located adjacent the upper end 13. A second opening 19 is located adjacent the first opening 17 either directly in a vertical line below the first opening 17 or directly horizontally alongside the first opening 17 or at an acute angle A inbetween as shown in FIGS. 3, 4 and 5. The second opening 19 is formed as the opening 17 resulting in a pair of horizontally aligned holes. Adjacent the lower end 15 of the anchor housing 11 is a third opening 21 located at right angles to the openings 17, 19 but again forming a pair of horizontal holes through the anchor housing 11.

A shaft or bolt 23 which is secured substantially vertically in a mounting block 25 in the ground serves as an anchor foundation. Preferably the mounting block 25 is a concrete block so as not to be readily removed from the ground by any unusual force. The exposed or upper end 27 of the shaft 23 includes a ring or eyelet 29.

A first pin 31 and a second pin 33 are provided through each of the first and second openings 17, 19 respectively as shown in FIGS. 2, 3, 4 and 5. Each of the pins 31, 33 may be a standard bolt threaded only at one end and secured by means of a bolt head at one end with a nut on the threaded end.

An elongated strap or belt 35 is passed, as seen in FIG. 1, from one side of the anchor housing 11 located on the side of a structure 37 up over the top of the structure 37 and down the other side the opposite anchor housing 11. As shown in FIG. 1, each strap 35 requires therefore two anchor housings 11, a left and a right, secured to separate anchor foundations formed from separate bolts 23 and mounting blocks 25. Each anchor housing 11 is located directly beneath the edge of the structure 37 to be held in place. The structure 37 is normally mounted on a support 38. Each anchor housing 11 is located so that the belt 35 will extend vertically in line with the side wall of the structure 37. A hook or eyelet 39 is located toward the center of the structure 37 preferably on a I-beam 40 situated on the support 38. A tie rod 41, located at an acute angle B to the ground, is connected at one end to the eyelet 39 on the structure 37 and the other end to the ring or eyelet 29 located at the upper end 27 of the shaft or bolt 23. A tie rod turn buckle 43 is located in the tie rod 41 for tensioning the tie rod 41.

As the belt 35 extends downwardedly from either side of the structure 37, it passes downwardedly around the outside of the first pin 31 back and around and over the top of the second pin 33 and again around and under the first pin 31. The belt 35 then extends diagonally over the top of and around under the second pin 33, and in between the two layers of the belt 35 against the first pin 31. In this way, the belt 35 is pulled tight against the two pins 31, 33 and the pressure of the belt 35 on the first and second pins 31, 33 prevents the belt 35 from slipping.

Figure 6:
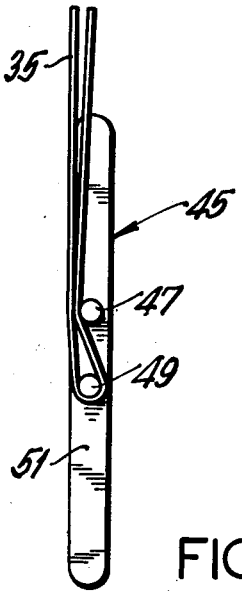
FIG. 6 is a side elevation of a winding tool used to form the strap for connection to the two pins of the anchor housing.

A tool 45 as shown in FIG. 6 may be used to form the belt 35. As part of the tool 45, a pair of pins 47, 49 are formed on a turn handle 51. The belt 35 is placed on an upper pin 47 and a lower pin 49 with the handle 51 straight up and down in a vertical position and the belt 35 in a vertical position. The strap is brought down around the lower pin 49 and up on the inside between the belt 35 and the upper pin 47. The vertically located handle 51 is then rotated three quarters of a turn. Then the belt 35 is placed in the anchor housing 11.

With the pins 31, 33 in place and the belt 35 in place, the anchor housing 11 is connected to the shaft or bolt 23 by an anchor turn buckle 53. The turn buckle 53 serves as a connector between the anchor housing 11 and the bolt 23. An upper bolt 55 of the turn buckle 53 has a hook or eyelet 57. A third pin 59 also in the form of a bolt with head and threaded nut is fitted in the third opening 21 and through the hook or eyelet 57. The hook or eyelet 57 is prevented from horizontal movement by a sleeve 61 also fitted over the third pin 59 within the anchor housing 11. However, when the second opening 19 is located at an acute angle from the horizontal and vertical with relationship to the first opening 17, as shown in FIG. 5, the sleeve 61 is split into a left sleeve 63 and a right sleeve 65 to permit the direction of the tension force to follow the belt 35. A lower bolt 67 in the turn buckle 53 has a hook or eyelet 69 connected to the hook or eyelet 29 located at the upper end 27 of the threaded shaft or bolt 23. The upper bolt 55 and the lower bolt 67 form an elongated member 71 extending between the anchor housing 11 and the threaded shaft or bolt 23.

Obviously, many modifications and variations of the present invention are possible in light of the above teachings. It is therefore to be understood that within scope of the appended claims the invention may be practiced by those of ordinary skill of the art other than as specifically described.

I claim:

1. An anchoring system for securing a structure with opposite sides to the ground, comprising:

an elongated flexible belt adapted to pass over said structure, said belt having two ends;

a pair of anchor housings located on opposite sides of said structure, both anchor housings each having an upper end and a lower end and having a first opening and a second opening and a third opening extending through each anchor housing, said first opening and said second opening being substantially parallel to one another and said first opening being located adjacent said upper end, said third opening being located adjacent said lower end and substantially at right angles to said first opening and said second opening;

a pair of first pins each located in the first opening of one of said anchor housings;

a pair of second pins each located in the second opening of one of said anchor housings, each end of said elongated flexible belt engaging both the first pin and the second pin in one of said anchor housings;

a pair of third pins each located in the third opening of one of said anchor housings;

a pair of anchor foundation means partially imbedded in the ground and located substantially directly vertically below opposite sides of said structure;

a pair of connecting means each including elongated members connected at one end to one of said third pins and at the opposite end to one of said anchor foundation means; and a pair of tie rods each connected at one end to one of said anchor foundation means and at the other end to said structure, each tie rod being located at an acute angle to the ground.

2. An anchoring system according to claim 1 wherein said pair of connecting means each include a turnbuckle.

3. An anchoring system according to claim 1 wherein both said pair of tie rods each include a turnbuckle.

4. An anchoring system according to claim 1 wherein said anchor housing is a hollow member.

5. An anchoring system according to claim 4 wherein said anchor housing has a substantially square cross-section.

6. An anchoring system according to claim 1 wherein said second opening is located substantially directly below said first opening and substantially midway between said upper end and said lower end of the anchor housing.

7. An anchoring system according to claim 6 wherein said first opening and said second opening are located toward the outside of said structure.

8. An anchoring system according to claim 1 wherein said first opening is located toward the outside of the structure and the second opening is located toward the inside of the structure.

9. An anchoring system according to claim 8 wherein said first opening and said second opening are both substantially an equal distance from said upper end of the anchor housing.

10. An anchoring system according to claim 8 wherein said second opening is located substantially midway between said upper end and said lower end of the anchor housing.

* * * * *